United States Patent [19]

DeBold et al.

[11] Patent Number: 4,994,122

[45] Date of Patent: Feb. 19, 1991

[54] CORROSION RESISTANT, MAGNETIC ALLOY ARTICLE

[75] Inventors: Terry A. DeBold, Wyomissing; Theodore Kosa, Reading; Millard S. Masteller, Fleetwood, all of Pa.

[73] Assignee: Carpenter Technology Corporation, Reading, Pa.

[21] Appl. No.: 379,486

[22] Filed: Jul. 13, 1989

[51] Int. Cl.[5] ..... C22C 38/18

[52] U.S. Cl. ..... 148/306; 148/333; 148/325

[58] Field of Search ..... 420/42, 67, 34, 104; 148/306, 325, 334, 333, 300

[56] References Cited

U.S. PATENT DOCUMENTS 3,052,576 9/1962 Josso ..... 148/306
3,401,035 4/1968 Moskowitz et al. ..... 420/42

FOREIGN PATENT DOCUMENTS 57-54252 3/1982 Japan ..... 148/306
6017055 1/1983 Japan ..... 420/42
61-117249 6/1986 Japan ..... 420/42

*Primary Examiner*—Deborah Yee
*Attorney, Agent, or Firm*—Dann, Dorfman, Herrell and Skillman

[57] ABSTRACT

A ferritic alloy, having an improved combination of magnetic properties and corrosion resistance, contains, in weight percent, about

| | % |
|---|---|
| Carbon | 0.03 max. |
| Manganese | 0.5 max. |
| Silicon | 0.5 max. |
| Sulfur | 0-0.5 |
| Chromium | 2-13.0 |
| Molybdenum | 0-1.5 |
| Nitrogen | 0.05 max. |

and the balance is essentially iron. The alloy, and articles made therefrom, provide higher saturation induction than known corrosion resistant, magnetic alloys.

7 Claims, No Drawings

CORROSION RESISTANT, MAGNETIC ALLOY ARTICLE

BACKGROUND OF THE INVENTION

This invention relates to a corrosion resistant, ferritic alloy and more particularly to such an alloy having a novel combination of magnetic and electrical properties and corrosion resistance.

Heretofore, silicon-iron alloys and ferritic stainless steels have been used for the manufacture of magnetic cores for relays and solenoids. Silicon-iron alloys contain up to 4% silicon and the balance is essentially iron. Such alloys have excellent magnetic properties but leave much to be desired with respect to corrosion resistance. Ferritic stainless steels, on the other hand, such as AISI Type 430F, provide excellent corrosion resistance, but leave something to be desired with respect to magnetic properties, particularly the saturation induction property. Saturation induction, or saturation magnetization as it is sometimes referred to, is an important property in a magnetic material because it is a measure of the maximum magnetic flux that can be induced in an article, such as an induction coil core, made from the alloy. Alloys with a low saturation induction are less than desirable for making such cores because a larger cross-section core is required to provide a given amount of magnetic attraction force as compared to a material with a high saturation induction. In other words, low saturation induction in a core material limits the amount of size reduction which can be accomplished in the design of relays and solenoids.

The increasingly frequent use of such automotive technologies as fuel injection, anti-lock braking systems, and automatically adjusting suspension systems in late model automobiles has created a need for a magnetic material having good corrosion resistance but higher saturation induction than known ferritic stainless steels. The need for good corrosion resistance is of particular importance in automotive fuel injection systems in view of the introduction of more corrosive fuels such as those containing ethanol or methanol.

In an attempt to provide materials having a combination of corrosion resistance, good magnetic properties, and good machinability the following alloys were developed. The alloys, designated QMRIL, QMR3L, and QMR5L, have the following nominal compositions in weight percent.

| | wt. % | | |
|---|---|---|---|
| | QMR1L | QMR3L | QMR5L |
| Si | 2 | 0.4 | 1.5 |
| Cr | 7 | 13 | 15 |
| Al | 0.6 | 1 | 1 |
| Fe | Bal. | Bal. | Bal. |

Each of the alloys also includes lead for the reported purpose of improving machinability.

U.S. Pat. No. 3,925,063 issued to Kato et al. on Dec. 9, 1975 relates to a corrosion resistant, magnetic alloy which includes a small amount of lead, calcium and/or tellurium for the purpose of improving the machinability of the alloy. The alloy has the following broad range in weight percent:

| | wt. % |
|---|---|
| C | 0.08 max. |
| Si | 0–6 |
| Cr | 10–20 |
| Al | 0–5 |
| Mo | 0–5 |

at least one of the following are included: 0.03–0.40% lead, 0.002–0.02% calcium, or 0.01–0.20% tellurium; and the balance is essentially iron.

U.S. Pat. No. 4,705,581 issued to Honkura et al. on Nov. 10, 1987 relates to a silicon-chromium-iron, magnetic alloy having some corrosion resistance. The alloy has the following broad range in weight percent:

| | wt. % |
|---|---|
| C | 0.03 max. |
| Mn | 0.40 max. |
| Si | 2.0–3.0 |
| S | 0–0.050 |
| Cr | 10–13 |
| Ni | 0–0.5 |
| Al | 0–0.010 |
| Mo | 0–3 |
| Cu | 0–0.5 |
| Ti | 0.05–0.20 |
| N | 0.03 max. |

and the balance essentially iron wherein $C+N \leqq 0.05\%$, and at least one of the following is included: 0.015–0.045% lead, 0.0010–0.0100% calcium, 0.010–0.050% tellurium or selenium.

U.S. Pat. No. 4,714,502 issued to Honkura et al. on Dec. 22, 1987 relates to a magnetic alloy having some corrosion resistance and which is reported to be suitable for cold forging. The alloy has the following broad range in weight percent:

| | wt. % |
|---|---|
| C | 0.03 max. |
| Mn | 0.50 max. |
| Si | 0.04–1.10 |
| S | 0.010–0.030 |
| Cr | 9.0–19.0 |
| Ni | 0–0.5 |
| Al | 0.31–0.60 |
| Mo | 0–2.5 |
| Cu | 0–0.5 |
| Ti | 0.02–0.25 |
| Pb | 0.10–0.30 |
| Zr | 0.02–0.10 |
| N | 0.03 max. |

and the balance essentially iron wherein $C+N \leqq 0.040\%$, $Si+Al \leqq 1.35\%$, and at least one of the following is included: 0.002–0.02% calcium, 0.01–0.20% tellurium, or 0.010–0.050% selenium.

The foregoing alloys include combined levels of chromium, silicon, and aluminum such that the alloys provide lower than desired saturation induction. The relatively high silicon and aluminum in some of those alloys also indicates that those alloys would have less than desirable malleability. Furthermore, all of the foregoing alloys contain lead which is known to present environmental and health risks in both alloy production and parts manufacturing.

SUMMARY OF THE INVENTION

It is a principal object of this invention to provide a corrosion resistant, magnetically soft alloy and an article made therefrom, which are characterized by an improved combination of magnetic properties and corrosion resistance.

More specifically, it is an object of this invention to provide such an alloy and article in which the elements are balanced to provide higher saturation induction than provided by known corrosion resistant, magnetic alloys.

The foregoing, as well as additional objects and advantages of the present invention, are achieved in a chromium-iron, ferritic alloy, and article made therefrom as summarized below, containing in weight percent, about:

| | Broad | Intermediate | Preferred |
|---|---|---|---|
| C | 0.03 max. | 0.02 max. | 0.015 max. |
| Mn | 0.5 max. | 0.2–0.4 | 0.2–0.4 |
| Si | 0.5 max. | 0.3 max. | 0.3 max. |
| S | 0–0.5 | 0–0.40 | 0.10–0.40 |
| Cr | 2–13.0 | 4–12 | 6–10 |
| Mo | 0–1.5 | 1.0 max. | 0.5 max. |
| N | 0.05 max. | 0.02 max. | 0.02 max. |

The balance of the alloy is essentially iron except for additional elements which do not detract from the desired properties and the usual impurities found in commercial grades of such steels which may vary from a few hundredths of a percent up to larger amounts which do not objectionably detract from the desired properties of the alloy.

The alloy is preferably balanced within the preferred range to provide a saturation induction of at least about 17.5 kilograms and corrosion resistance in corrosive environments, such as fuel containing ethanol or methanol. Sulfur is preferably limited to about 0.05% max. when the alloy is to be cold formed rather than machined.

The foregoing tabulation is provided as a convenient summary and is not intended to restrict the lower and upper values of the ranges of the individual elements of the alloy of this invention for use solely in combination with each other, or to restrict the broad or preferred ranges of the elements for use solely in combination with each other. Thus, one or more of the broad and preferred element ranges can be used with one or more of the other ranges for the remaining elements. In addition, a broad or preferred minimum or maximum for an element can be used with the maximum or minimum for that element from one of the remaining ranges. Here and throughout this application percent (%) means percent by weight, unless otherwise indicated.

DETAILED DESCRIPTION

The alloy according to the present invention contains at least about 2%, better yet at least about 4%, preferably at least about 6%, and still better yet at least about 8%, chromium to benefit the corrosion resistance of the alloy. Too much chromium adversely affects the saturation induction of this alloy such that above about 13.0% chromium the desired saturation induction is no longer provided. Accordingly, the alloy contains not more than about 13.0%, e.g., 12.75% max. or 12.5% max., chromium. Better yet not more than about 12%, and preferably not more than about 10% chromium is present in this alloy.

Up to about 1.5% molybdenum can be present in this alloy because it contributes to the corrosion resistance of the alloy in a variety of corrosive environments, for example, fuels containing methanol or ethanol, chloride-containing environments, environments containing pollutants, such as $CO_2$ and $H_2S$, and acidic environments containing for example, acetic or dilute sulfuric acid. When present, molybdenum also benefits the electrical resistivity of this alloy. Molybdenum, however, adversely affects the saturation induction of the alloy and, preferably, no more than about 1.0%, better yet, no more than about 0.5% molybdenum is present.

From a small but effective amount up to about 0.5% sulfur can be present and preferably about 0.10–0.40% sulfur is present to benefit the machinability of the alloy. Selenium can be substituted for some or all of the sulfur on a 1:1 basis by weight percent.

Sulfur is not desired, however, when articles are to be cold formed from the alloy because sulfur adversely affects the malleability of the alloy. Accordingly, if the alloy is to be cold formed rather than machined or hot formed, preferably no more than about 0.05% sulfur is present.

Manganese can be present and preferably at least about 0.2% manganese is present in this alloy because it benefits the hot workability of the alloy, workability of the alloy. Manganese also combines with some of the sulfur to form manganese sulfides which benefit the machinability of the alloy. Too much manganese present in such sulfides adversely affects the corrosion resistance of this alloy and, therefore, no more than about 0.5%, preferably no more than about 0.4%, manganese is present.

Silicon can be present in this alloy as a residual from deoxidizing additions. When present silicon stabilizes ferrite in the alloy and contributes to the good electrical resistivity of the alloy. Excessive silicon adversely affects the cold workability of the alloy, however, and, accordingly, silicon is controlled such that no more than about 0.5%, preferably not more than about 0.3% silicon is present in the alloy.

The balance of this alloy is essentially iron except for the usual impurities found in commercial grades of alloys for the same or similar service or use and those additional elements which do not detract from the desired properties. The levels of such elements are controlled so as not to adversely affect the desired properties of the alloy. In this regard carbon and nitrogen are each limited to not more than about 0.05%, better yet not more than about 0.03%, e.g., 0.025% max., and preferably to not more than about 0.02%, e.g., 0.015% max. Furthermore, titanium, aluminum, and zirconium are preferably limited to no more than about 0.01% each; copper is preferably limited to no more than about 0.3%; nickel is preferably limited to no more than about 0.5%, better yet to no more than about 0.2%; and lead and tellurium are preferably limited to not more than about twenty parts per million (20ppm) each in this alloy.

The alloy according to this invention does not require any unusual preparation and can be made using conventional, well known techniques. The alloy is preferably melted in an electric arc furnace and refined by the argon-oxygen decarburization (AOD) process. The alloy is preferably hot worked from a temperature in the range 2000–2200F and can be readily cold worked when the alloy contains no more than about 0.05% sulfur, as previously discussed. The alloy is preferably normalized after hot working. For a billet having a thickness up to about 2in, the alloy is preferably normalized by heating at about 1830F for at least about lh and then cooling in air. A larger size billet is heated for a commensurately longer time.

The alloy is heat treated by annealing for at least about 4 hours at a temperature preferably below the ferrite-to-austenite transition temperature. The annealing temperature and time are selected based on the actual composition and part size to provide an essentially ferritic structure preferably having a grain size of about ASTM 8 or coarser. For example, when the alloy contains less than about 4% or more than about 10% chromium the annealing temperature is preferably not higher than about 1475F, whereas when the alloy contains about 4-10% chromium, the annealing temperature is preferably not higher than about 1380F. Cooling from the annealing temperature is preferably carried out at a sufficiently slow rate to avoid residual stress in an annealed article.

The alloy according to the present invention can be formed into various articles including billets, bars, and rod. In the annealed condition the alloy is suitable for use in magnetic cores for induction coils used in solenoids, relays and the like for service in such corrosive environments as alcohol containing fuels and high humidity atmospheres.

EXAMPLES

Examples of the alloy of the present invention having the compositions in weight percent shown in Table I were prepared. By way of comparison, Example alloys A and B outside the claimed range, having the compositions in weight percent also shown in Table I were obtained from previously prepared commercial heats. Example A is representative of ASTM A838-Type 2, a known ferritic stainless steel alloy and Example B is representative of ASTM A867-Type 2F, a known silicon-iron alloy.

TABLE I

| Ex. # | % C | % Mn | % Si | % P | % S | % Cr | % Ni | % Mo | % Cu | % Co | % N | % O | % Fe |
|---|---|---|---|---|---|---|---|---|---|---|---|---|---|
| 1 | 0.023 | 0.41 | 0.31 | 0.022 | 0.28 | 2.08 | 0.20 | 0.31 | <0.01 | <0.01 | 0.015 | 0.0083 | BAL |
| 2 | 0.023 | 0.41 | 0.32 | 0.023 | 0.28 | 4.06 | 0.20 | 0.31 | <0.01 | <0.01 | 0.016 | 0.0101 | BAL |
| 3 | 0.025 | 0.41 | 0.32 | 0.021 | 0.29 | 6.06 | 0.20 | 0.31 | <0.01 | <0.01 | 0.017 | 0.0104 | BAL |
| 4 | 0.022 | 0.43 | 0.33 | 0.022 | 0.28 | 8.09 | 0.20 | 0.31 | <0.01 | <0.01 | 0.023 | 0.0114 | BAL |
| 5 | 0.018 | 0.40 | 0.29 | 0.019 | 0.30 | 7.94 | 0.18 | 0.30 | <0.01 | <0.01 | 0.017 | 0.0085 | BAL |
| 6 | 0.024 | 0.43 | 0.32 | 0.022 | 0.30 | 10.1 | 0.20 | 0.30 | <0.01 | <0.01 | 0.019 | 0.0110 | BAL |
| 7 | 0.020 | 0.43 | 0.32 | 0.021 | 0.30 | 2.11 | 0.20 | 1.00 | <0.01 | <0.01 | 0.015 | 0.0090 | BAL |
| 8 | 0.022 | 0.43 | 0.32 | 0.021 | 0.30 | 4.06 | 0.20 | 1.00 | <0.01 | <0.01 | 0.018 | 0.0105 | BAL |
| 9 | 0.021 | 0.43 | 0.32 | 0.021 | 0.27 | 6.10 | 0.20 | 1.00 | <0.01 | <0.01 | 0.017 | 0.0104 | BAL |
| A | 0.032 | 0.47 | 1.40 | 0.017 | 0.28 | 17.64 | 0.24 | 0.29 | 0.05 | — | — | — | BAL |
| B | 0.016 | 0.25 | 2.39 | 0.129 | 0.039 | 0.10 | 0.05 | 0.01 | 0.03 | — | — | — | BAL |

Examples 1–4 and 6–9 were 17 lb heats induction melted under argon and cast into 2.75in square ingots. Example 5 was a 400 lb heat induction melted under argon heat and cast into a single 7.5in square ingot. Examples A and B were obtained from production-size mill heats that were electric arc melted and refined by AOD.

Examples 1–4 and 6–9 were each press forged from a temperature of 2100F to 1.25in square bar. Heat 5 was press forged from 2100F to a 3.5in round cornered square (RCS) billet. A portion of the RCS billet was hot pressed to 1.25in square bar.

Bar segments, each about 10 in long, were cut from the pressed bars of Examples 1–9, normalized at 1832F for 1h and then cooled in air. The normalized bars were milled to 1 in square. The bars from Examples 1–4 and 6–9 were annealed at 1472F for 4h in a dry forming gas containing 85% nitrogen and 15% hydrogen, and then furnace cooled at about 200F°/h, to provide samples for magnetic and electric testing. The bar from Example 5 was annealed similarly but at 1380F, the preferred annealing temperature for that composition.

Direct current (dc) magnetic testing of Examples 1–9 was conducted per ASTM Method A341. The maximum permeability was determined using a Fahy permeameter. The residual induction, the maximum induction, and the coercive force were measured at a magnetizing force of 200 oersteds (Oe) on the Fahy permeameter. The saturation induction was determined by extrapolation of induction data as a function of magnetizing force up to a maximum magnetizing force of 1500 Oe.

The electrical resistivity was determined by measuring the voltage drop across a fixed length of the bar at various dc currents up to 100 amperes and plotting a Y-I characteristic curve from the measured test data.

The results of the magnetic and electric testing for Examples 1–6 are shown in Table II including the maximum permeability ($\mu$max), the residual induction ($B_r$) in kilograms (kG), the coercive force ($H_c$) in oersteds (Oe), the induction at 200 Oe ($B_m$) and the saturation induction ($B_s$) in kilogauss (kG), and the electrical resistivity ($\rho$) in micro-ohm-centimeters ($\mu\Omega$-cm). The percent chromium and percent molybdenum for each example are also given in Table II for easy reference.

TABLE II

| | | | Magnetic-Electric | | | | | |
|---|---|---|---|---|---|---|---|---|
| Ex. | % Cr | % Mo | $\mu$max | $B_r$ (kG) | $H_c$ (Oe) | $B_m$ (kG) | $B_s$ (kG) | ($\mu\Omega$-cm) |
| 1 | 2.08 | 0.31 | 1610 | 6.02 | 2.79 | 18.7 | 20.0 | 27.6 |
| 2 | 4.06 | 0.31 | 1410 | 5.88 | 2.82 | 18.3 | 19.5 | 36.4 |
| 3 | 6.06 | 0.31 | 1040 | 6.16 | 3.66 | 17.9 | 18.9 | 43.6 |
| 4 | 8.09 | 0.31 | 895 | 6.18 | 4.06 | 17.4 | N.T. | 49.4 |
| 5 | 7.94 | 0.30 | 1620 | 8.20 | 3.36 | 17.6 | 18.3 | N.T. |
| 6 | 10.1 | 0.30 | 925 | 5.69 | 3.77 | 16.9 | 17.9 | 52.5 |
| 7 | 2.11 | 1.00 | 1870 | 6.30 | 2.52 | 18.4 | 18.5 | 29.8 |
| 8 | 4.06 | 1.00 | 1400 | 6.62 | 3.02 | 18.1 | 18.4 | 38.6 |
| 9 | 6.10 | 1.00 | 1280 | 6.54 | 3.22 | 17.7 | 18.0 | 45.4 |
| A | 17.6 | 0.29 | NOT TESTED | | | | 15.2 | 76 |
| B | 0.10 | 0.01 | NOT TESTED | | | | 20.6 | 40 |

N.T. = Not Tested

Table II shows the improved saturation induction provided by this alloy in comparison with the known ferritic stainless steel. The data also show that the saturation induction provided by the present alloy approaches that of the silicon-iron alloy. It is also worthwhile to note the improvement in the coercive force between Examples 4 and 5: the former being annealed at an arbitrary temperature and the latter being annealed at the preferred temperature.

Additional samples of Examples 1-3, 5, and 6, and the samples of Examples A and B were hot rolled from a temperature of 2100F to 0.19in thick strips and 2.25 in long segments were cut from each strip. Strip segments of Examples 1-3, 5, and 6, and of Example A were annealed at 1380F for 4h in dry forming gas and furnace cooled. The strip segments of Example B were annealed at 1550F for 4h in wet hydrogen and then furnace cooled at a rate of 150F° /h. Standard corrosion testing coupons 2in x lin x 0.125in were machined from the annealed segments and surface ground to a 32 micron finish. All of the coupons were cleaned ultrasonically and then dried in alcohol.

Duplicate coupons of each example were tested in a salt spray of 5% NaCI at 95F in accordance with ASTM Standard Method B117. Additional, duplicate coupons of each material were tested for corrosion resistance in a 95% relative humidity environment at 95F. The results of the salt spray and humidity tests for each test specimen are shown in Table III. For the humidity test the data include the time to first appearance of rust (lst Rust) in hours (h), and a rating of the degree of corrosion after 200h (200h Rating). For the salt spray test, the data include the time to first appearance of rust (lst Rust) in hours (h), a rating of the degree of corrosion after lh (lh Rating), and a rating of the degree of corrosion after 24h (24h Rating). The rating system used is as follows: 1=no rusting; 2=1 to 3 rust spots; 3=approx. 5% of surface rusted; 4=5 to 10% of surface rusted; 5 =10 to 20% of surface rusted; 6=20 to 40% of surface rusted; 7 =40 to 60% of surface rusted; 8 =60 to 80% of surface rusted; 9=more than 80% of surface rusted. Only the top face of each coupon was evaluated for rust.

Samples of Examples 1-4 and 6-9 were prepared similarly to the previous samples except that they were annealed at 1475F. Duplicate coupons of each example were tested for resistance to corrosion in a simulated corrosive fuel mixture of 50% ethanol and 50% corrosive water at room temperature for 24h, from which the rates of corrosion in mils per year (MPY) were calculated. The results of the corrosive fuel testing are shown in Table III under the heading "Corrosive Fuel". By way of comparison a sample of Example A measuring 0.450in round x 1 in long and a sample of Example B measuring 1.25 in square x 0.19in thick were also tested and their results are shown in Table III.

TABLE III

| | 95% Humidity | | Corrosive Fuel | Salt Spray | | |
|---|---|---|---|---|---|---|
| Ex. | 1st Rust (h) | 200h Rating | Corr. Rate (MPY) | 1st Rust (h) | 1h Rating | 24h Rating |
| 1 | 1/1 | 9/9 | 4.6/4.6 | 1/1 | 8/8 | 9/9 |
| 2 | 1/1 | 8/8 | 3.4/3/7 | 1/1 | 7/7 | 9/9 |
| 3 | 2/2 | 7/7 | 1.5/2.0 | 1/1 | 7/7 | 9/9 |
| 4 | N.T. | N.T. | 0.9/1.1 | NOT TESTED | | |
| 5 | 4/4 | 5/5 | N.T. | 1/1 | 6/6 | 9/9 |
| 6 | 8/24 | 3/3 | 0.2* | 1/1 | 6/6 | 9/9 |
| 7 | N.T. | N.T. | 4.4/4.5 | NOT TESTED | | |
| 8 | N.T. | N.T. | 2.4/3.1 | NOT TESTED | | |

TABLE III-continued

| | 95% Humidity | | Corrosive Fuel | Salt Spray | | |
|---|---|---|---|---|---|---|
| Ex. | 1st Rust (h) | 200h Rating | Corr. Rate (MPY) | 1st Rust (h) | 1h Rating | 24h Rating |
| 9 | N.T. | N.T. | 1.1/1.1 | NOT TESTED | | |
| A | 96/96 | 3/3 | 0 | 1/1 | 3/3 | 4/4 |
| B | 1/1 | 9/9 | 19.8 | 1/1/ | 7/7 | 9/9 |

N.T. = Not Tested
*Only one sample tested.

Table III shows the improved corrosion resistance of this alloy compared to the silicon-iron alloy in high humidity and corrosive fuel environments. The salt spray 24h test appears to be too severe for this alloy as it does not adequately discriminate between the examples of the present alloy and the comparative examples.

It is apparent from the foregoing description and the examples, as set forth in Tables II and III, that the alloy according to the present invention provides a unique and improved combination of magnetic properties and corrosion resistance. The alloy is well suited to applications where high saturation induction, low coercive force and good electrical resistivity are required and where the in-service environment is corrosive.

The terms and expressions which have been employed herein are used as terms of description and not of limitation. There is no intention in the use of such terms and expressions to exclude any equivalents of the features described or any portions thereof. It is recognized, however, that various modifications are possible within the scope of the invention claimed.

What is claimed is:

1. A corrosion resistant, magnetic article formed of an alloy consisting essentially of, in weight percent, about

| | % |
|---|---|
| Carbon | 0.025 max. |
| Manganese | 0.2-0.5 |
| Silicon | 0.5 max. |
| Sulfur | 0-0.5 |
| Chromium | 2-10 |
| Molybdenum | 1.0 max. |
| Nitrogen | 0.025 max. |

and the balance essentially iron, said article having been annealed at a temperature below the ferrite-to-austenite transition temperature of said alloy for at least about 4 hours and further characterized by having a saturation induction of at least about 17.5 kG and a coercive force of not more than about 4 Oe.

2. An article as set forth in claim 1 wherein the alloy contains at least about 4% chromium.

3. An article as set forth in claim 2 wherein the alloy contains about 0.3% max. silicon.

4. An article as set forth in claim 3, wherein the alloy contains about 0.05% max. sulfur.

5. An article as set forth in claim 2 that has ben annealed at a temperature of not higher than about 1380F for at least about 4 hours.

6. An article as set forth in claim 1 wherein said alloy, in the annealed condition, has an essentially ferritic structure having a gram size of about ASTM 8 or coarser.

7. An article as set forth in claim 1 wherein the alloy contains at least about 6% chromium.

* * * * *

UNITED STATES PATENT AND TRADEMARK OFFICE

CERTIFICATE OF CORRECTION

PATENT NO. : 4,994,122

DATED : February 19, 1991

INVENTOR(S) : TERRY A. DeBOLD, THEODORE KOSA and MILLARD S. MASTELLER

It is certified that error appears in the above-identified patent and that said Letters Patent is hereby corrected as shown below:

Column 3,

Line 38: "kilograms" should be --kilogauss--.

Column 6,

Line 22: "Y-I" should be --V-I--;

Line 27: "kilograms" should be --kilogauss--.

Claims,

Claim 5, line 1: "ben" should be --been--.

Claim 6, line 3: "gram" should be --grain--.

Signed and Sealed this

Thirtieth Day of June, 1992

*Attest:*

DOUGLAS B. COMER

*Attesting Officer*

*Acting Commissioner of Patents and Trademarks*